United States Patent [19]

Ervine

[11] 4,116,109

[45] Sep. 26, 1978

[54] AMMUNITION LOADING MACHINE

[75] Inventor: Albert W. G. Ervine, Bridgeport, Conn.

[73] Assignee: Remington Arms Company, Inc., Bridgeport, Conn.

[21] Appl. No.: 709,811

[22] Filed: Jul. 29, 1976

[51] Int. Cl.[2] ..... F42B 33/02

[52] U.S. Cl. ..... 86/23; 74/820

[58] Field of Search ..... 86/23–39; 74/813, 817, 820

[56] References Cited

U.S. PATENT DOCUMENTS

| | | | |
|---|---|---|---|
| 454,578 | 6/1891 | Jacobs | 86/27 |
| 2,366,811 | 1/1945 | Sibson, Jr. et al. | 86/23 X |
| 2,663,421 | 12/1953 | Reynolds et al. | 86/25 X |
| 3,170,333 | 2/1965 | Umbrecht | 74/820 UX |
| 3,483,792 | 12/1969 | Williams | 86/27 |

*Primary Examiner*—Harold J. Tudor
*Attorney, Agent, or Firm*—William L. Ericson; Nicholas Skovran

[57] ABSTRACT

An ammunition loading machine in which a drive chassis intermittently indexes an annular dial to transport empty shell casings to a series of loading stations, and reciprocates ram means to actuate tooling and fixtures for performing successive loading operations on the shells. The dial, ram means, tooling and fixtures are mounted on a base plate assembly to form a die set which is detachable as a unit from the drive chassis, and is easily replaceable by a different die set when ammunition of changed specifications is to be loaded.

The drive chassis includes ram drive rods and a dial indexing mechanism which are readily separable from the ram means and dial to facilitate replacement of the die set. The bearings for the dial comprise roller means which also serve to form a separable driving connection with the indexing mechanism to rotate the dial. A plurality of the ram drive rods, spaced apart and extending through the base plate assembly within a central opening in the dial, are provided to stabilize the ram means, and also to drive first and second ram means at different rates for operating various fixtures.

12 Claims, 16 Drawing Figures

AMMUNITION LOADING MACHINE

BACKGROUND AND BRIEF DESCRIPTION OF THE INVENTION

This invention relates to machines for loading ammunition automatically, and has particular reference to machines for loading shotshells, although the concepts of the invention are not limited in usefulness to that specific purpose. Machines of this general ty0pe serve to load empty shell casings automatically with preselected quantities of propellant and shot or other projectiles, and with wads and shot protectors of numbers and types appropriate to the intended use of the particular type of shell, to crimp or otherwise close the mouths of the shells, to carry out appropriate inspections at various phases of loading, and to reject improperly loaded shells.

An example of such a machine appears in U.S. Pat. No. 2,663,421 granted to W. S. Reynolds et al on Dec. 22, 1953, and assigned to the owner of the present application. Such known machines are well suited for continuous, high-volume production of shells of any given gauge and load specification, and are therefore economical for loading the types of shells in greatest demand. There is however a need to supply the less popular loads and gauges of shotshells, which are not required in sufficient quantities to utilize the output capacity of an automatic loading machine for any extended period of time. These types of shells must therefore be produced in job lots, and the loading machine's tooling must be converted from one load specification to another between each lot. Such a changeover requires an extensive shutdown period for known types of machines, whose designs are not inherently well adapted to facilitate these alterations. Consequently, the cost of production of the less popular loads and guages of shells is disproportionately higher than the cost of varieties which are in greater demand.

The improved machine employs a drive chassis which produces two principal motions. These are the intermittent rotation or indexing of a dial about an axis to transport shell casings successively to a series of circumferentially-spaced loading stations, and the reciprocation of ram means along the same axis to actuate tooling which performs various loading steps. These are the same principal motions carried out by known machines exemplified by the aforementioned U.S. Pat. No. 2,663,421. Additionally, various fixtures require other individual motions; these include, for example, powder and shot dispensers, transfer mechanisms for feeding empty shell casings to the dial, and rotary crimping fixtures. In known machines, the structural relationships and connections of the drive chassis, ram, and machine frame with various fixtures are too inflexible or too complex to permit easy rearrangement for loading shells of a significantly different specification.

It is an object of this invention to expedite the production of ammunition in limited quantities or job lots by simplifying the changeover of the tooling of automatic loading machines from one shell gauge or type of load to another. It is another object to provide an ammunition loading machine of an improved, versatile design which permits the ready replacement as a unit of a complete set of tooling by another complete set. The improved machine makes it feasible to keep on hand several complete tooling assemblies, or die sets, each prearranged for a different gauge or type of load, and to interchange die sets between the loading of job lots o widely different specifications. Additional advantage of the improved loading machine will appear from th following description.

Briefly, according the one aspect of my invention, mount the dial, ram means, and appropriate tooling an fixtures on a base plate assembly. These elements com prise a die set. The chassis includes readily-detachabl drive rod means for the ram means and indexing mean for the dial. The die set may be disassembled from th chassis by lifting it as a unit off the chassis housing. A shell transfer mechanism incorporated in the drive chas sis is arranged to remain in place when the die set i removed, since it is unnecessary to relocate the statio of this mechanism when changing die sets.

The facility with which the die set may be joined an detached from the drive chassis is enhanced by severa further improvements. Rather than being rotatabl mounted on the drive chassis by a central shaft an bearings, the dial is formed as a ring, and mounted o the base plate assembly of the die set by roller mean which serve not only as the dial bearings, but also coop erate with the indexing mechanism of the drive chassi to perform the function of indexing the dial.

This arrangement of the dial and roller means no only reduces the complexity of the mechanism by per forming dual functions, but also permits a plurality o ram drive rods to be extended from the drive chassi upwardly through different regions of a stationary cen tral portion of the base plate assembly. This afford inherently greater resistance to tilting of the ram mean by bending moments applied to the tooling than woul the conventional use of a single drive rod arranged o the central axis of reciprocation.

I also take advantage of the possibility of using multi ple ram drive rods to operate two independent rams, th first being reciprocated at the full rate of the machin cycle to actuate the bulk of the fixtures and tooling, an the second at half the rate of the machine cycle. Th second half-speed ram is used to operate powder an shot charging dispensers of a preferred type, known pe se, in which a reciprocable charging slide has two me tering chambers, one of which is charged with powde or shot from a hopper while the other discharges into shell casing, at either end of the charging slide stroke This allows a greater period for the slide to dwell a either end of the stroke, and thus more time for th powder and shot to flow completely into and out of th metering chambers, than with a single-acting chargin dispenser having only one metering chamber.

DESCRIPTION OF THE DRAWINGS

THE DIE SET

Figure 1:
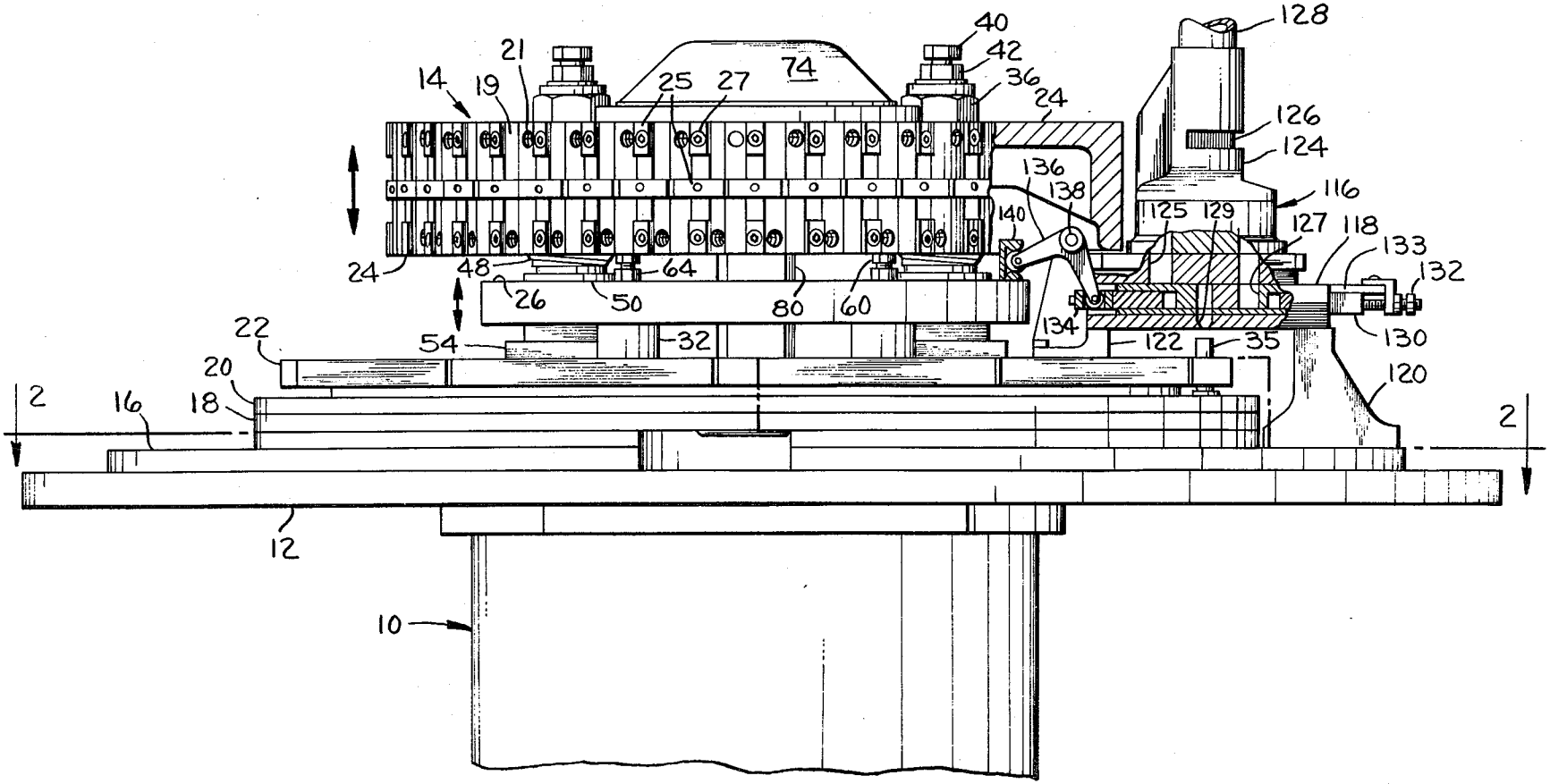
FIG. 1 is a fragmentary, partially-sectional view i side elevation of a preferred embodiment of the im proved ammunition loading machine, shown with shot or powder dispenser mounted in operative relatio but without other tooling.
Figure 2:
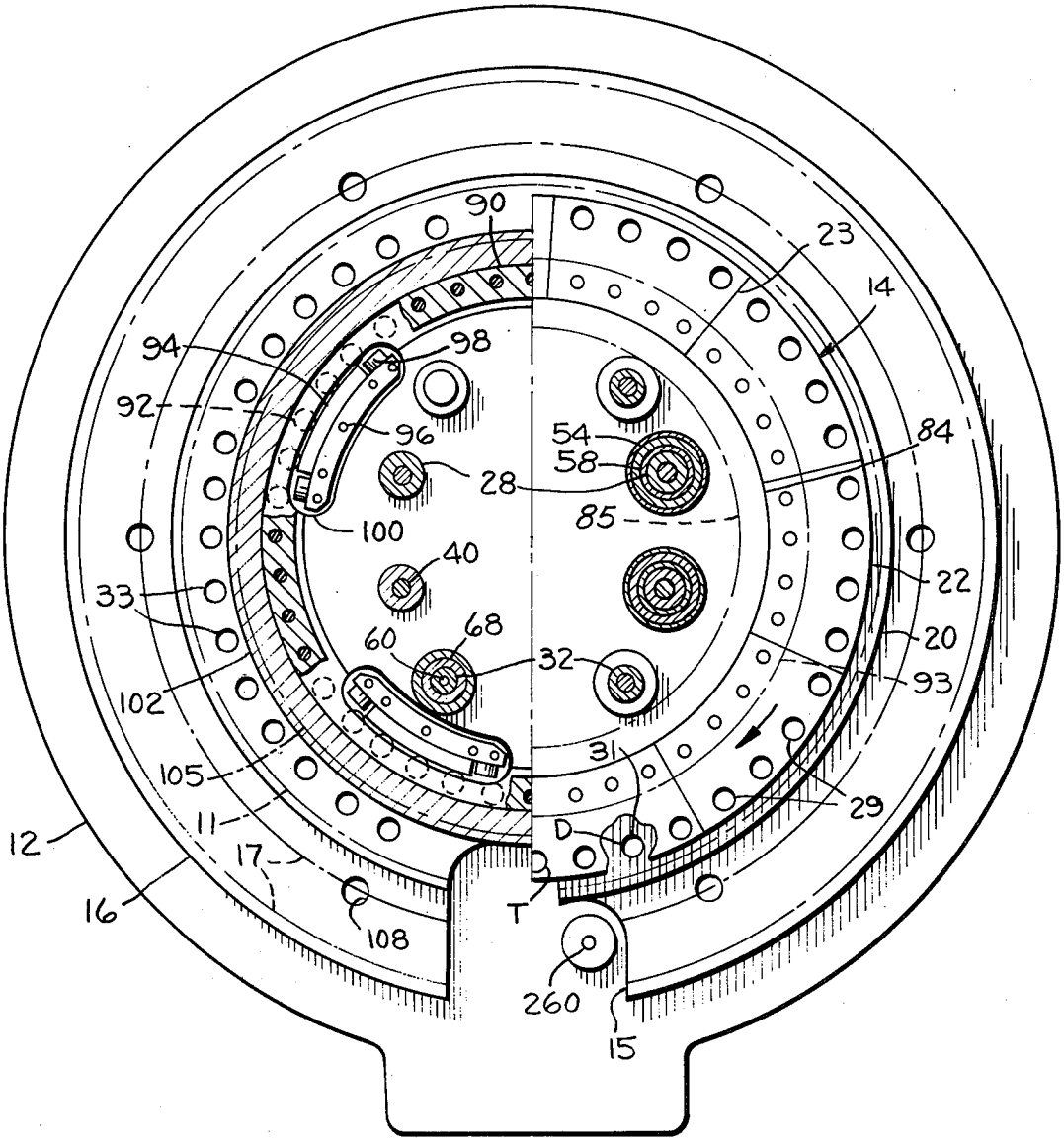
FIG. 2 is a sectional plan view taken along line 2— in FIG. 1, looking in the direction of the arrows.
Figure 3:
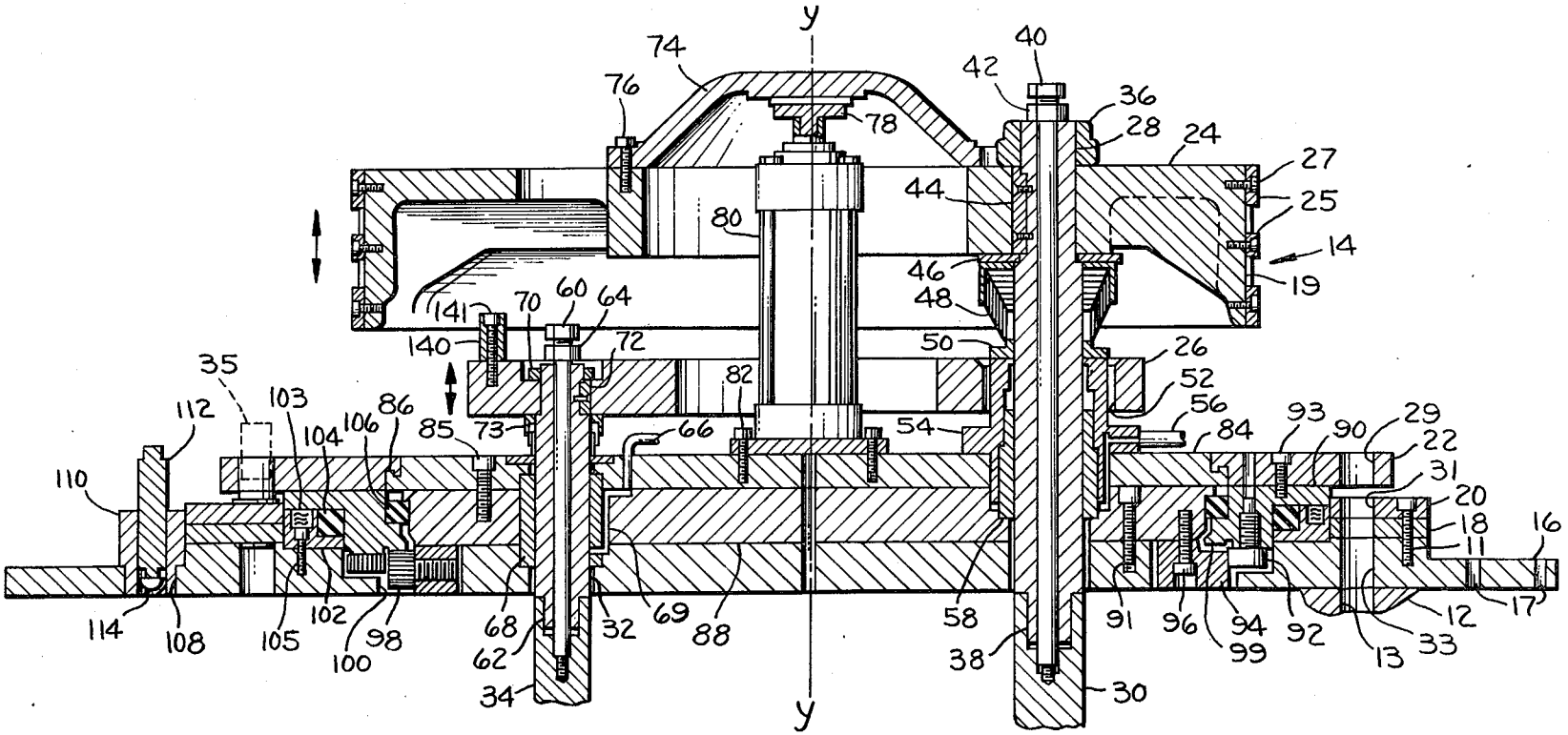
FIG. 3 is a fragmentary sectional view in side elev tion showing details of a die set subassembly of th machine.

Referring first to FIGS. 1-3, a preferred construction of the improved machine includes two major subassemblies. One of these is a drive chassis generally indicated at 10, which incorporates a deck 12; the other is a die set 14, which is mounted on the deck. The die set has a base plate assembly comprising a base plate 16, an annular bolster 18 and rail 20, and disks 88 and 84. The elements of the base plate assembly are secured together by circumferentially-spaced screws 11, 85, and 91, and the die set 14 is detachably mounted on the deck 12 by screws (not shown) received through holes 17 in the base plate 16.

Figure 16:
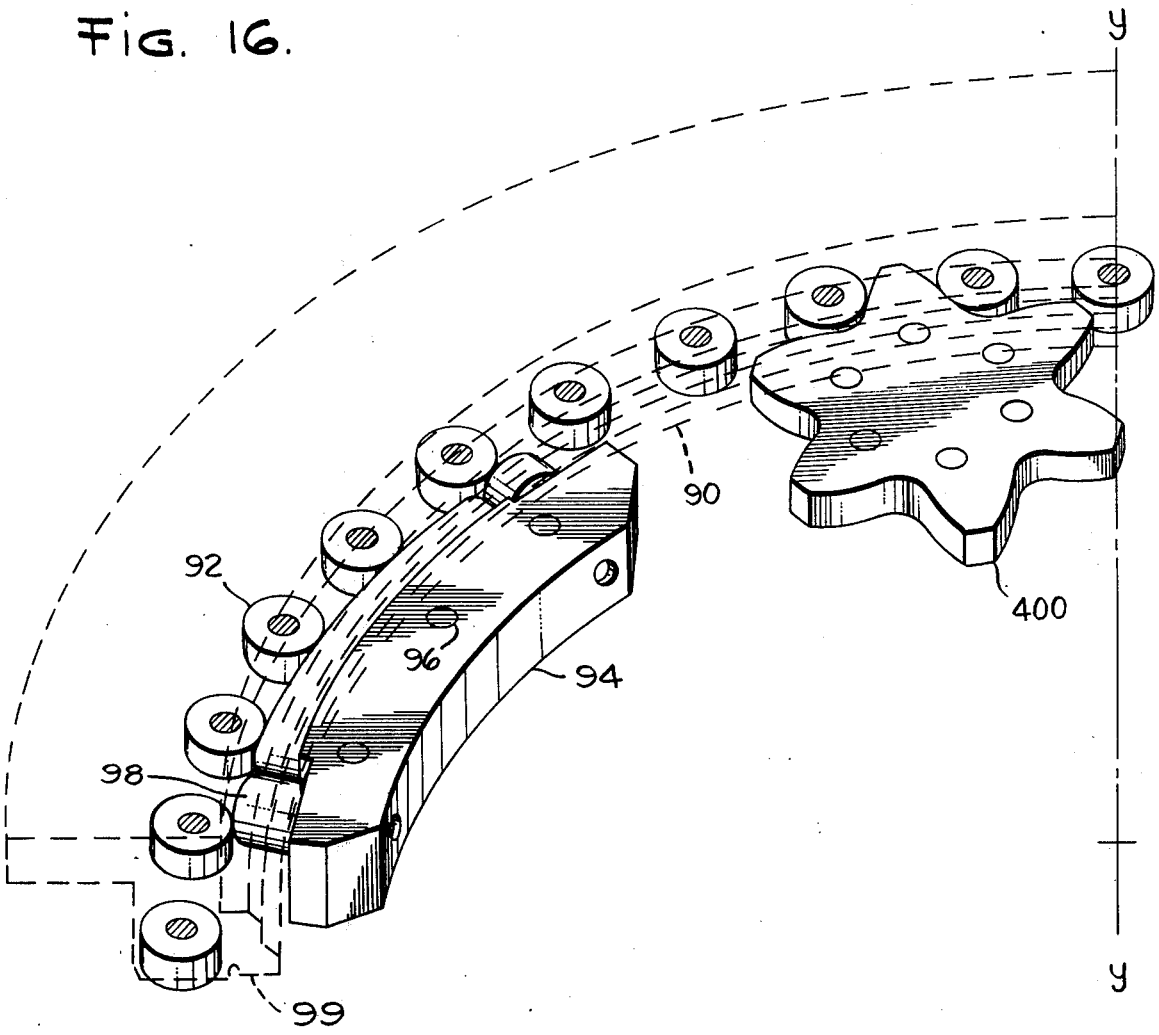
FIG. 16 is a pictorial view illustrating a portion of the dial index mechanism and one quadrant of the dial bearing arrangement.

An annular dial 22, comprising arcuate segments 23 (see FIG. 2) secured to a supporting ring 90 by a series of screws at 93, has a thrust bearing surface 99 which is supported on a series of rollers 98 for rotation about a principla axis *y—y* of the machine (FIGS. 3 and 16). These rollers have their axles extending radially of the axis *y—y* and threaded into a plurality of arcuate shoes 94, which are spaced at intervals about the base plate 16 in recesses 100 formed therein, and secured to the bottom of the disk 88 by screws 96.

The dial 22 is given radial bearing support by a second series of rollers 92, whose axles extend parallel to the axis *y—y* and are threaded into the supporting ring 90. The rollers 92 bear against the outer arcuate surfaces of the shoes 94, which cooperate to define a circumferentially-extending segmental surface of revolution generated about the axis *y—y*. This arrangement obviates the need for a dial bearing located centrally of the machine about the axis *y—y*, and thus allows a stationary base plate assembly 16, 88, 84 to be located within an annular dial 22 and to extend upwardly through it, for a purpose which will shortly be explained. The rollers 92 serve a dual purpose, cooperating with an indexing mechanism including a star wheel 400 for intermittently indexing the dial about the axis *y—y*, as well as acting as radial bearings for the dial.

To prevent dust, loose propellant powder, or other foreign materials from reaching the dial bearing rollers 92 and 98, a tongue-and-groove arrangement of circumferential flanges 86 is formed between the dial 22 and the disk 84, and an elastomeric lip-type seal 106 is placed in rubbing engagement between the dial and the disk 88. A ring 102, attached to the base plate 16 by screws 102, supports an elastomeric lip-type seal 104 and a felt dust seal 103 in rubbing engagement with an outside circumferential surface of the dial to complete the sealing of the dial bearing rollers.

A series of pockets 29 are circumferentially spaced about the dial 22 to receive empty shotshell casings 35, which rest slidably on the rail 20 and are transported about the axis *y—y* to a series of loading stations defined by the positions of the pockets at successive dial-indexing steps. As illustrated in FIG. 2, the dial is indexed clockwise in the direction shown by the arrow to transport shell casings from a shell transfer station T, at which an empty casing is inserted into a pocket 29 by a transfer mechanism whose location is generally indicated by an element 260 thereof, and which will later be described in detail. The shell, after being loaded by passing through all of the loading operations which may be provided for, is released from the machine at a discharge station D, being allowed to fall through aligned discharge holes 31, 33, and 13 formed in the rail 20 and bolster 18, base plate 16, and deck 12 (see FIG. 3) to a suitable collector or packer (not shown).

The illustration in FIG. 2 shows a larger number of pockets 29 than the number of loading stations that will normally be required; this affords maximum versatility, since additional fixtures can be placed at unused stations as required when changing the load specification, without disturbing existing fixture placements and connections. A large number of discharge holes 31, 33, and 13 are also shown in FIG. 2; any of these may be used if desired to reject defectively-loaded shells at various selected stages of loading, by extending retractable plungers or slides (not shown) into the holes to support acceptable shells and thus retain them in the pockets 29 for transportation to further loading stations, and by retracting these plungers in response to signals supplied by suitable inspection devices (not shown) to indicate the presence of a defective shell. These holes 31, 33, and 13 which are not located either at the discharge station D or at a selected rejection station are suitably plugged, so that the shells will remain in the pockets 29 as they pass over these holes.

At stations located between the transfer station T and the discharge station D, appropriate fixtures are mounted on the base plate 16 to carry out the loading operations required for a particular shell specification. Examples of suitable fixtures are shown in the aforementioned U.S. Pat. No. 2,663,421. These may include inspection devices, wad and shot protector feeders and inserting mechanisms, powder and shot dispensers, shell printers, reject mechanisms, crimping or other closureforming fixtures, and others as required, whose selection and construction is well known to those skilled in the art. For purposes of explaining the novel features of the present invention, only two such fixtures are illustrated in the drawings, including a shot or powder dispenser shown in FIG. 1, and a wad or shot protector feeding and inserting mechanism shown in FIGS. 4 and 5, both of which will be described in more detail under separate headings.

The majority of the fixtures are actuated at the full rate of the machine cycle, but preferred types of shot and powder dispensers require actuation at half that rate. To achieve this and to obtain maximum versatility of the machine, I provide plural ram means comprising a first ram or cross-head 24 which is reciprocated along the axis *y—y* at the full machine cycle rate to actuate the majority of the fixtures, and a second ram or cross-head 26 which is reciprocated in parallel directions at half the cycle rate to actuate the powder and shot dispensers, such as 116 in FIG. 1. One or more yokes 140 are attached to the ram 26 by screws 141 for operating these dispensers.

The outer peripheral surface of the ram 24 is formed with a series of flats 19 accurately spaced at regular angles, to which ground keys 25 are attached by screws 27 to form a series of circumferentially spaced pads for the attachment of loading fixtures in accurate register with the indexed positions of the pockets 29 at the various loading stations. Tapped holes 21 (see FIG. 1) are formed in the flats 19 for the mounting of the fixtures. A flat is formed in angular register with each pocket 29; not all the flats would normally be used, but this provision facilitates tooling modifications.

To counterbalance the weight of the massive ram 24 and the attached fixtures, and thereby reduce inertial loading of the drive mechanism at the ends of the stroke, a pneumatic counterbalance cylinder 80 (see FIG. 3) of a known type is secured to the disc 84 of the base plate assembly by screws 82. The cylinder 80 has a pad 78, which is attached to its movable piston, bearing against a dome 74 attached to the ram 24 by screws 76.

The first ram 24 is reciprocated and supported by a set of four drive rod extensions 28, arranged in symmetrically-spaced pairs to afford increased resistance to bending moments applied to the ram. The second ram 26 is similarly reciprocated and supported by another set of four drive rod extensions 32, also arranged in symmetrically-spaced pairs, and spaced apart from the extensions 28 as shown in FIG. 2. This advantageous arrangement is made feasible by the use of an annular dial 22 and a stationary base plate assembly 16, 88, 84 extending through the dial.

The rod extensions 28 are drivingly connected with four corresponding drive rods 30 of the drive chassis in a detachable manner by socket joints 38 as shown in FIG. 3, and by studs 40 threaded into the rods 30 and secured by lock-nuts 42. The ram 24 rests against rings 46 supported by shoulders formed in each rod extension 32, and is keyed at 44 to each rod extension, while nuts 36 hold the ram securely in place. Slide bushings 58 seated in openings formed through the base plate assembly guide the rod extensions, and are lubricated through housings 54 by lubricant supply tubes 56. Pads 50 atop the housings 54 support helical spring rod covers 48 to prevent the entry of foreign matter into the slide bushings.

The rod extensions 32 of the second ram 26 are similarly arranged, being drivingly connected with four corresponding drive rods 34 of the drive chassis in a readily-detachable fashion by socket joints 62, and by studs 60 threaded into the rods 34 and secured by lock-nuts 64. The ram 26 rests against shoulders formed in each rod extension 32, and is keyed at 72 to each rod extension, while nuts 70 hold the ram in place. Slide bushings 68 seated in openings formed through the base plate assembly guide the rod extensions, and are lubricated through passages 69 by lubricant supply tubes 66. Helical spring rod covers 73 seal the gaps between the ram 26 and the base plate assembly.

To remove the entire die set 14 as a unit from the drive chassis 10, it is only necessary to unscrew the studs 40 and 60 from the drive rods 30 and 34, respectively, to remove the screws attaching the base plate 16 to the deck 12 from the holes 17, and to lift the die set off the deck. A driving connection formed between the rollers 92 and an indexing mechanism of the drive chassis is so arranged as to be disconnected merely by lifting the die set, as will appear hereinafter. A series of tapped holes 108 is formed in the base plate 16, and temporary plugs 110 are screwed into them. Jackscrews 112, preferably having self-leveling pads 114, are threaded through the plugs 110 and bear against the deck 12 to raise the die set parallel to the axis *y—y*. Following this initial separation, the die set may be carried away by a hoist. Another complete die set may then be attached and drivingly connected to the drive chassis by reversing this simple procedure.

FIXTURES ACTUATED BY HALF-SPEED RAM

The second or half-speed ram 26 is used to operate powder and shot charging dispensers of a known double-acting type in which two metering chambers are provided in a charging slide, one of these being loaded with a charge of powder or shot from a supply hopper while the other discharges into a shotshell. To illustrate a fixture of this type, a shot dispenser 116 is shown in FIG. 1. The dispenser is mounted on the stationary base plate assembly 16, 84 by brackets 120 and 122, and is supplied with shot through a tube 128 and a hopper 124 having an adjustable flow regulator 126 of a known type. A charging slide 130 is reciprocated in horizontal directions in a housing 118 by the vertical movements of the ram 26, by means of a bell-crank 136 pivoted at 138 on the bracket 122 and connected by rollers with the yoke 140 and a yoke 134 secured to the charging slide. Two metering chambers 127 are formed in the slide 130, spaced apart a distance equal to the stroke of the slide, so that a different one of them is aligned above a discharge port 129 at either end of the stroke to release a metered charge of shot into a waiting shotshell 35, during the same time interval that the other is aligned below a corresponding one of two outlet ports 125 in the hopper 124 to receive a new charge of shot. A short time delay is required for the gravitational flow of shot to either fill or drain a metering chamber completely. Since the illustrated dual-chamber dispenser requires operation at only half the machine cycle rate, the machine may be operated at a considerably greater rate than it could if single-chamber dispensers were used, without interfering with the necessary delays for proper shot flow. The half-speed ram 26 affords a convenient means for actuating these dual-chamber dispensers with a minimum of complication of the drive mechanism, and of the procedure required for replacing the die set.

The dispenser 116 is provided with an adjusting mechanism 132, 133, which is more fully described in the co-pending application Ser. No. 635,897 of R. N. Hamlin filed Nov. 28, 1975 and assigned to the owner of this application, to permit the volume of the shot charges metered by the chambers 127 to be altered for different loading specifications.

FIXTURES ACTUATED BY FULL-SPEED RAM

Figure 5:
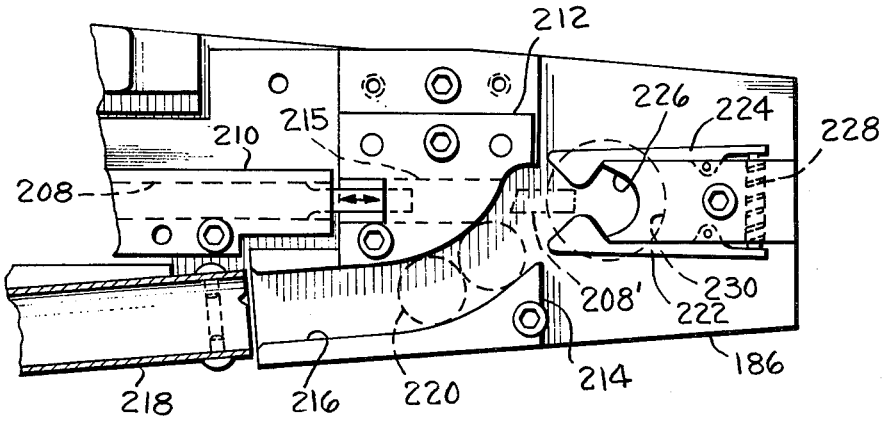
FIG. 5 is a fragmentary plan view on an enlarge scale of a portion of the wad or component loader FIG. 4.
Figure 4:
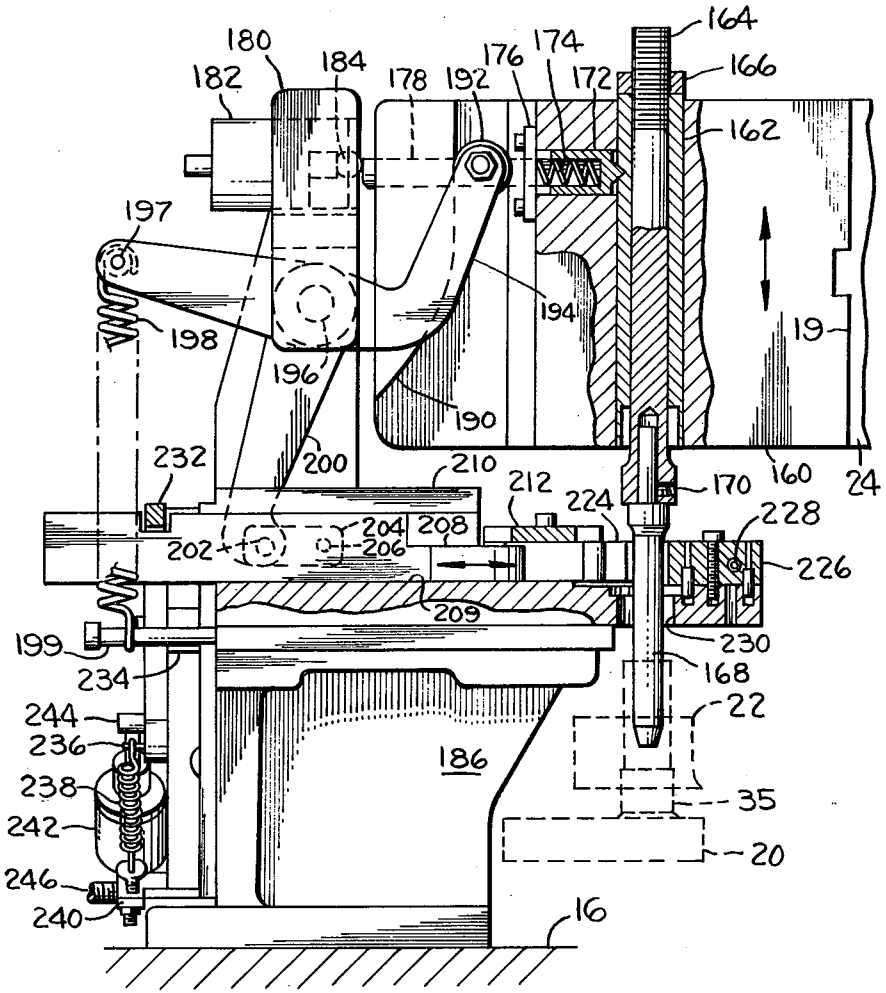
FIG. 4 is a fragmentary partially-sectional view i side elevation showing a wad or component load connected to the loading machine.
Figure 7:
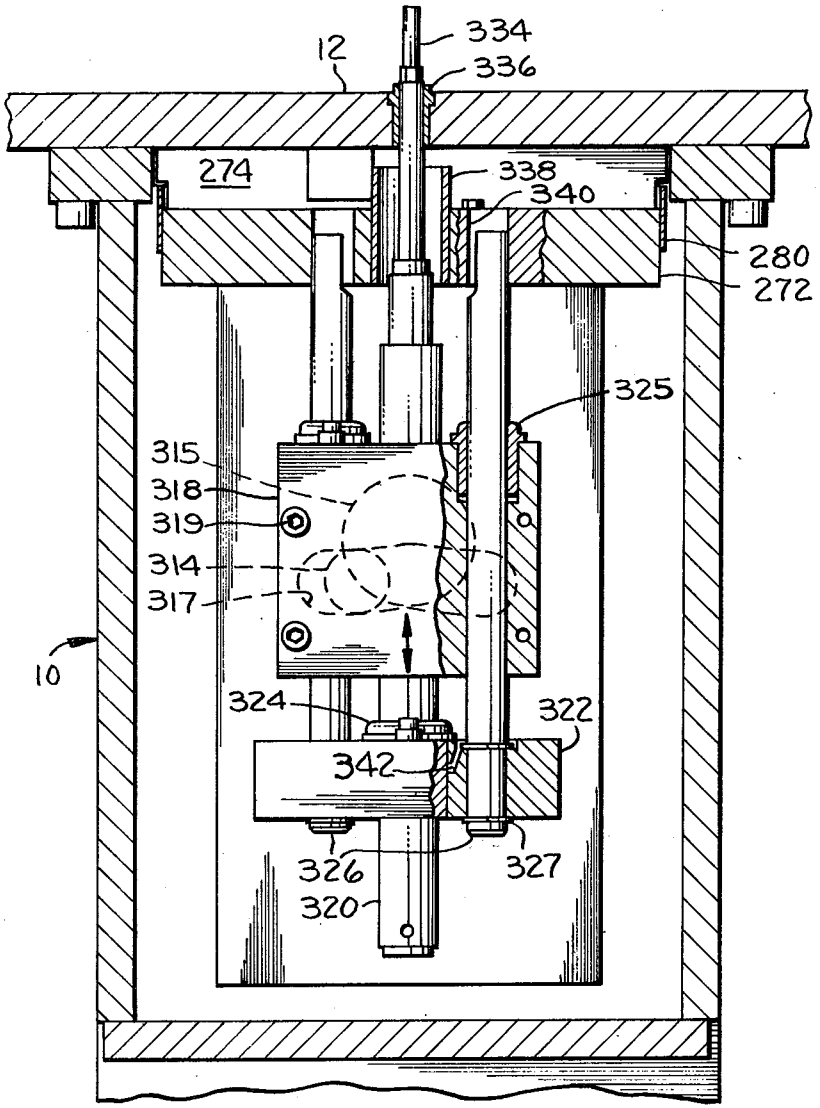
FIG. 7 is a fragmentary sectional view in end elevation, taken along line 7—7 in FIG. 6 looking in the direction of the arrows, showing a portion of a shell transfer mechanism.

The bulk of the shell loading operations, apart from the dispensing of powder and shot just described, are performed by various fixtures which are actuated by the first or full-speed ram 24. Suitable fixtures are well known to those skilled in the art; several examples are illustrated by the aforementioned U.S. Pat. No. 2,663,421. As these form no part of the present invention, no complete set of tooling will be described herein. However, to more fully illustrate the mode of operation of the machine, one example of such a fixture is shown in FIGS. 4 and 5, comprising a loader for feeding and inserting wads, shot protectors, or other components into the shotshells. The fixture includes a head 160 which is attached to one of the flats 19 of the ram 24 at a selected station around its periphery, and which reciprocates with the ram in vertical directions as shown by the arrows. The head carries a wad-inserting punch 168 in a position to press a wad (not shown) into a shell 35 on the downstroke of the ram, and to retract from the shell as the ram rises and the dial 22 indexes.

The mounting of the punch 168 permits it to yield in the event that it encounters a defective shell, or the wad for any reason fails to seat properly in the shell. The punch is secured by a set screw 170 in a stud 164, which is threaded in a sleeve 162 to permit adjustment of the punch elevation, and secured in adjusted position by a lock nut 166. The sleeve 162 is slidably received in the head 160, and yieldably engaged by a movable detent 172 which is biased into engaging relation by a compression spring 174 secured by a retainer 176. In the event of a jam, the unseated detent 172 releases the punch 168, and displaces a slidable plunger 178 to the left as viewed in FIG. 4, to engage a ball actuator 184 which in turn operates a switch 182 which is arranged to disconnect the power supply of the machine, and thereby discontinue further operation until the cause of the jam is corrected. The switch 182 is mounted in a bracket 180 secured to a base 186 of the fixture, which is in turn affixed to the base plate 16 of the die set.

A crank 194 is pivotally mounted at 196 in the bracket 180, and is biased in a counterclockwise direction as viewed in FIG. 4 by a tension spring 198 connected between a pin 197 affixed to the crank and a pin 199 secured in the base 186. Another arm of the crank supports a cam follower 192 which bears against a cam surface 190 formed in the head 160. A lever 200 affixed to the crank 194 is drivingly connected by a link 204 and pins 202, 206 with a wad feed slide 208. The cam surface 190 is so formed that the lever 200 is biased by the spring 198 to drive the slide 208 to the right as the ram 24 approaches the top of its stroke, and is retracted toward the position shown in FIG. 4 as the ram approaches the bottom of its downstroke. Thus the slide 208 is normally caused to reciprocate in the directions shown by the arrows, being guided in this motion between a planar surface 209 and a guide 210 attached to the base 186.

According to an optional feature, the feeding of components by the slide 208 may be selectively discontinued although the machine continues in operation, as for example when a given load specification does not call for the component supplied by a particular loading fixture. This is accomplished by a latch lever 232 pivoted at 234 on the base 186. A tension spring 238, engaged between a fixed bracket 240 and a pin 236 attached to the latch lever 232, biases the latch lever into engagement with a notch in the slide 208 as shown in FIG. 4. To free the slide 208 for normal feeding motion, fluid pressure is supplied from a suitable source through a conduit 246 to an actuator 242, in a manner to displace a stud 244 on the latch lever 232 in a direction to pivot the latch lever out of engagement with the slide.

A supply chute 218, shown in FIG. 5, supplies components, such as generally indicated at 220, to a curved track formed between plates 216 and 212 secured to the base 186. This track guides successive components to a position in front of the slide 208 when the slide is retracted within a passage 215 under the plate 212. As the slide moves forwardly to an extended position at 208', it pushes a single component between a pair of jaws 222, 224 pivotally mounted on a recessed block 226, and biased to yieldingly grip the component by a compression spring 228. The descent of the ram 24 and the punch 168 then presses the component downwardly through an opening 230 and into seated relation in a waiting shotshell 35.

DRIVE CHASSIS

Figure 6:
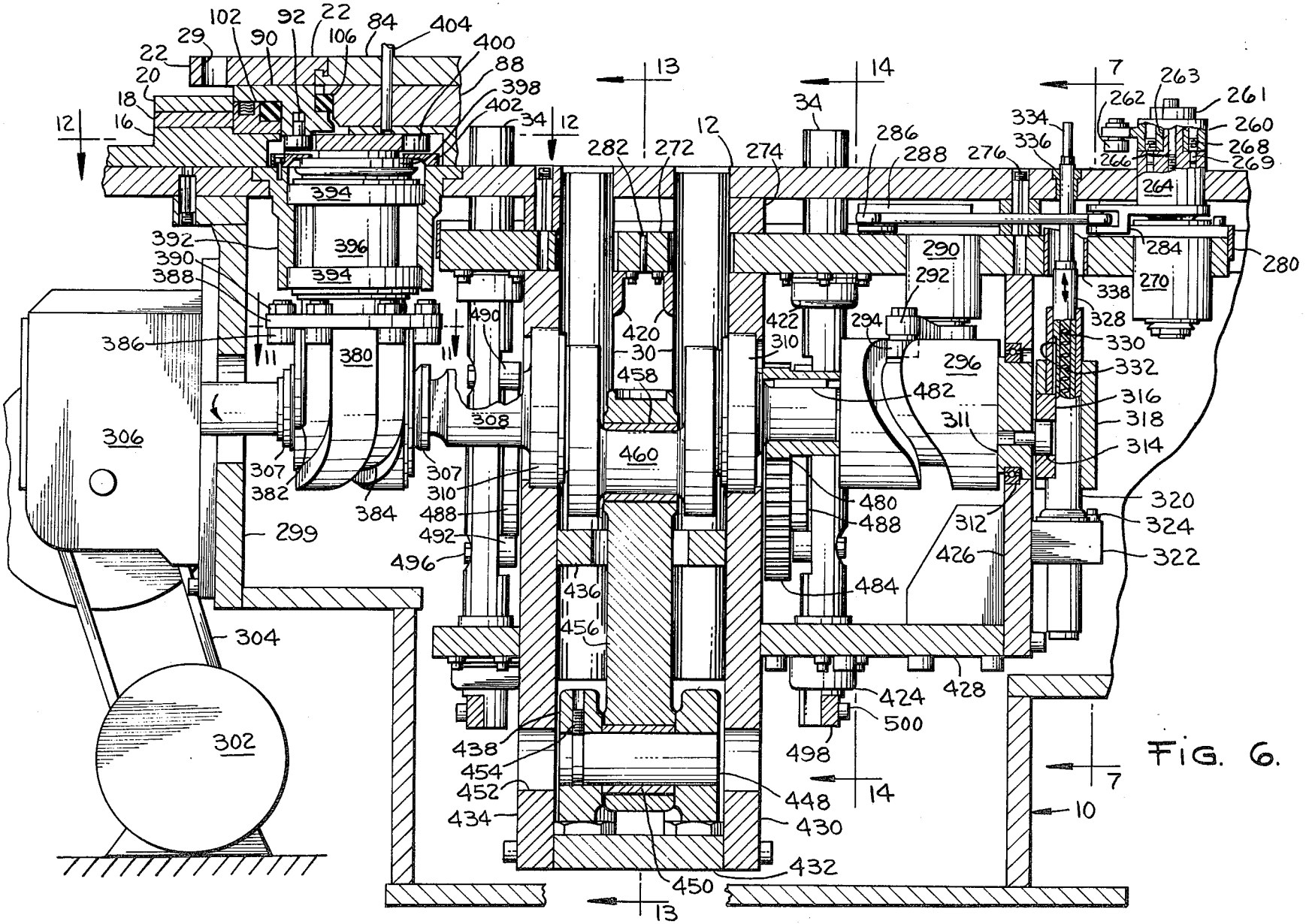
FIG. 6 is a fragmentary sectional view in side elevation showing details of a drive chassis subassembly of the machine.

As shown in FIG. 6, the drive chassis 10 is enclosed by a housing which includes structural members 272, 274, 299, 426, 428, 430, 432, 434, and 436, all securely attached together by bolts, screws, or welding. The deck 12 is aligned in accurate register with internal elements of the drive chassis by means of expansion dowels 276. A main crank shaft 308 is driven through a speed reducer 306 and a belt 304 by a suitable motor 302, and is rotatably supported in bearings 310. The crank shaft 308 drives a rotary indexing cam 380 having adjusting nuts 307, a crank portion 460 of the shaft, a pinion gear 480 through a key 482, a rotary shell transfer cam 296, and a hub 311 rotatably supported in a bearing 312 and carrying an eccentric drive roller 314. These elements actuate various mechanisms which will now be described under separate headings for the sake of convenient reference.

SHELL TRANSFER MECHANISM

The mechanism for transferring shells to the pockets 29 of the dial 22 is shown in FIGS. 6–10, and includes as its driving elements the rotary cam 296 and the drive roller 314. As appears in FIGS. 6 and 7, the roller 314 is mounted eccentrically of an axis defined by the bearing 312 of the hub 311, to rotate in a circular path 315, and is engaged in a curved cam track 317 of a modified Scotch yoke 316 mounted in a slide block 318. This assembly is secured and engaged with an actuating tube 320 by screws 319, and is mounted for vertical reciprocation in directions shown by the arrows by means of slide bushings 324 and 325. The bushings 325 are slidably engaged on a pair of guide rods 326 secured in openings 340 in the plate 272, and attached to a fixed cross bar 322 by retaining rings 327, while the bushing 324 is mounted directly in the cross bar. This provides a three-point support for guiding the slide block 318 smoothly without binding. A tubular push rod 328, which mounts a shell lifter punch 334, is telescopically received within the actuating tube 320. The push rod 328 is biased upwardly by an internal compression spring 330, and has a slot 332 in which it may slide relative to the modified Scotch yoke 316, so that the shell lifter punch 334 can yield in the event of a jam occurring on its upstroke. The push rod 328 is guided by a slide bushing 336 received through the deck 12.

Lubrication of the bushings 324 and 325 is provided by a lubricant tray defined by a rim 280 surrounding the plate 272, and feeding the bushings through clearances between the rods 326 and the openings 340, and passages 342 in the cross bar 322. A collar 338 surrounds an enlarged opening through the plate 272, required for passage of the actuating tube 320, to prevent lubricant from reaching the lifter punch 334 and being carried by it through the bushing 336 to contaminate the ammunition being loaded.

Figure 8:
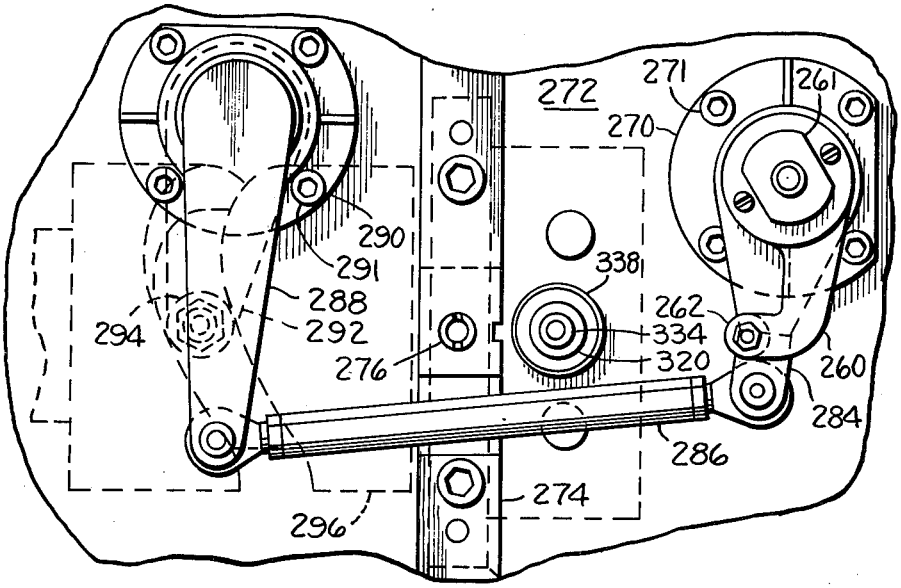
FIG. 8 is a fragmentary plan view showing another portion of the shell transfer mechanism.

The rotary transfer cam 296, as appears in FIGS. 6 and 8, has a circumferential cam track which guides a follower 294 to oscillate a crank 292. This crank is rotatably mounted in a bearing housing 290 attached to the plate 272 by screws 291, and has an output arm 288 which transmits its oscillations through a pivotally-connected turnbuckle 286 to a further crank 284, rotatably mounted in a bearing housing 270 attached to the plate 272 by screws 271. The purpose of this multiple-crank and turnbuckle mechanism is to transfer oscillating motion from the interior of the drive chassis to a shell insertion crank 260 located radially outside the dial 22 (see FIG. 2).

As shown in FIG. 6, the crank 284 is secured to a drum 264 passing freely through the deck 12 and rotatably mounted on the housing 270. The shell insertion crank 260 is rotatably mounted on a spindle 263 integral with the drum 264, and is retained by a screw 266 and nut 261. A yieldable driving connection is formed between the crank 260 and the drum 264 by the engagement of spring detent plungers 268 with indented plugs 269 received in these members, so that the crank and a drive roller 262 attached thereto may yield in case a jam develops in the shell transfer operation.

Figure 9:
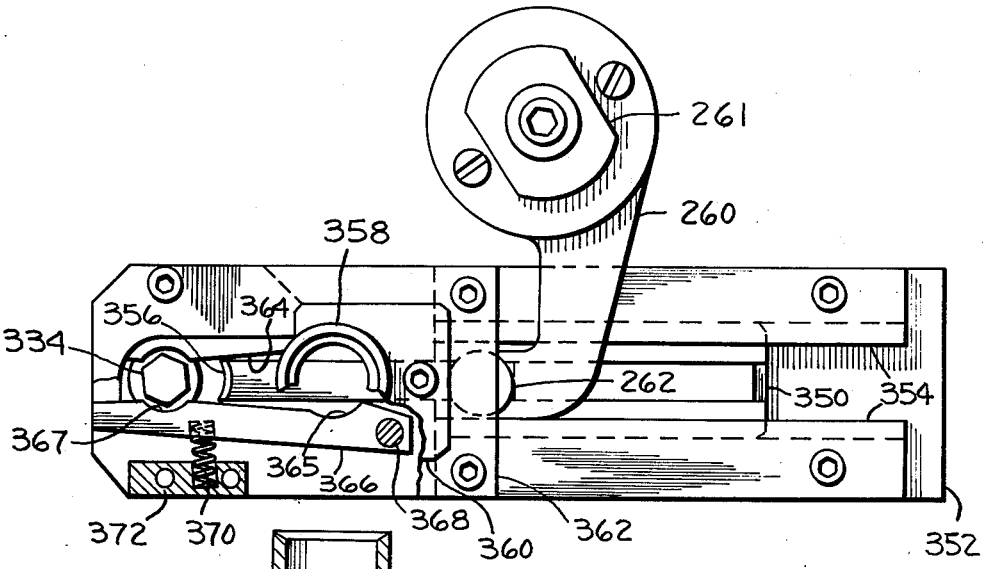
FIG. 9 is a fragmentary plan view showing additional elements of the shell transfer mechanism.
Figure 10:
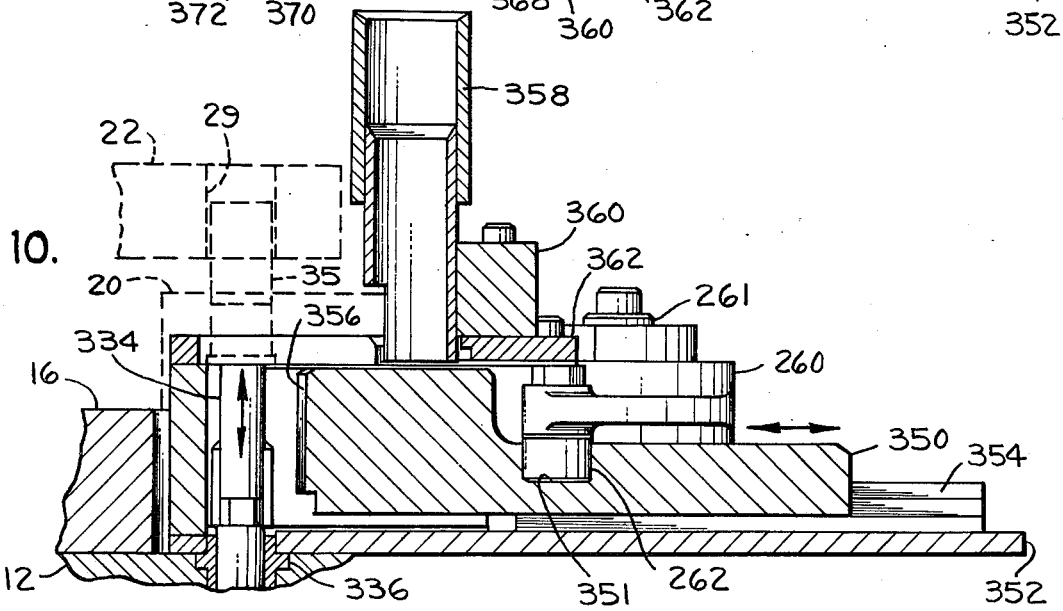
FIG. 10 is a fragmentary partially-sectional view in side elevation of the mechanism of FIG. 9.

Referring now to FIGS. 9 and 10, a drive roller 262 mounted on the crank 260 is received in a slot 351 formed in a shell transfer slide 350. Thus the oscillation of the crank reciprocates the slide horizontally within guideways 354 mounted on a base plate 352 secured to the deck 12. A supply tube 358, to which empty shotshells are fed in a vertical stack by an elongated pipe (not shown), is secured to the base plate 352 by housing members 360, 362. As the slide 350 is retracted to the right in the drawings from its illustrated advanced position, a curved lip 356 passes to the right of the supply tube, permitting the stack of shells to drop toward the base plate 352 by the length of approximately one shell. The space between the housing member 362 and the base plate is sufficient to receive a single shell, and the remainder of the stack is supported on top of the slide 350 when it is returned towards its advanced position and pushes the single shell from under the stack.

A pair of jaws 364, 366 are pivoted on the base plate as at 368, and biased toward one another by compression springs 370 mounted in retainers 372. These jaws have arcuate recesses 365 which provide sufficient clearance for a shell to fall onto the base plate 352. As the slide 350 advances to the left in the drawings, the lip 356 pushes a shell between the jaws, which spread to receive and guide it with an upright orientation.

The top of the shell lifter punch 334 is withdrawn by the modified Scotch yoke 316 to the level of the base plate 352 before the slide 350 reaches its fully-advanced position and places the shell directly over and in alignment with the punch. Arcuate recesses 367 in the jaws 364 and 366 temporarily receive and resiliently hold the shell in this position as the slide 350 retreats to the right. Now the punch 334 moves upwardly to raise the shell shown at 35 in an intermediate position partially inserted into a pocket 29 of the dial 22, which is held stationary in an indexed position during the transfer operation. The upward motion of the punch 334 is terminated when the base of the shell 35 reaches the level of the rail 20, and the punch dwells in this extended position until after the commencement of the next indexing rotation of the dial 22 carries the pocket and the inserted shell laterally off the punch and onto the surface of the rail for subsequent loading. The punch is then lowered to the base plate 352, and the mechanism is in readiness to transfer another shell into the next succeeding pocket of the dial.

DIAL INDEXING MECHANISM

A mechanism for intermittently rotating the dial 22 to index its pockets 29 to successive loading stations is shown in FIGS. 6, 11, 12, and 16. The indexing cam 380, which is of a known, commercially-available type, has a single continuous track 384 having an entry 382 at its left end as viewed in the drawings, and a corresponding exit (not shown, lying on the reverse face) at its right end. The track 384 cooperates with six cam follower rollers 386 equiangularly spaced at 60° intervals in a circular arrangement and mounted on a disc 388 by means of nuts 390 threaded on the axles 385 of the rollers. The track 384 engages one pair of adjacent rollers 386 at a time, holding them stationary through a large arcuate portion of each revolution of the cam as they engage circular segments of the track. Reaching the curved track segments, the rollers 386 are advanced 60° in a clockwise direction as viewed in FIG. 11; a leading roller exits from the cam as the roller shown in the left-hand portion of the track 384 advances to the right-hand portion, and a third roller enters the track at 382 shortly thereafter.

The intermittent rotation of the rollers 386 is transmitted to a star wheel 400 through a coupling 398 and a vertical shaft 396, the latter being rotatably mounted in a housing 392 by means of bearings 394. A cover ring 402 attached to the housing encloses the bearings 394. The star wheel 400 projects upwardly from the deck and has teeth formed to continuously engage successive adjacent pairs of the dial rollers 92, which are mounted on the dial support ring 90 as previously described. The teeth of the star wheel are formed with a profile which gives a precise correspondence between the angular displacements of the cam rollers 386 and the dial rollers 92, that is, a uniform speed ratio of the star wheel to the dial. This insures uniform and precise positioning of the pockets 29 at the loading stations as the dial is indexed. The teeth of the star wheel 400 have surfaces which lie at distances, measured along normals thereto, equal to the radii of the rollers 92, from a cycloidal or trochoidal locus. A cycloidal locus requires some relief to avoid undercutting, but this will not result in lost motion if a plurality of the rollers are in contact with the teeth at all times.

The dial is intermittently rotated by the indexing mechanism to a series of equiangularly-spaced indexed positions, in which it is held stationary during an interval in each cycle of revolution of the crank shaft 308. During these intervals, fresh empty shotshells are transferred into successive empty pockets 29 of the dial a the transfer station T (FIG. 2) by the transfer mechanism 260, 334, 350, etc., loading operations are performed by the die set 14 on shells in pockets at intermediate stations, and loaded shells are released at the discharge station D.

The teeth of the star wheel 400 have active faces which extend parallel to the dial axis *y—y* (FIGS. 3 and 16), as do the axes of the rollers 92; and although these parts are drivingly engaged, they are free for relative displacement along the axis *y—y*. Consequently, the indexing mechanism may be connected with, or disconnected from, the die set 14 merely by lowering or raising the die set to or from seated engagement with the deck 12. It will be apparent that the axes of the rollers 92 might be inclined inwardly toward the top of the machine, and the star wheel given a conjugate conical form, without detracting from this simple method of connecting and disconnecting the indexing drive. In that case, the rollers 92 could serve both as thrust and radial bearings for the dial 22, and the thrust rollers 98 could be omitted. This alternative is not preferred, however, because of the tendency toward positional instability of a dial resting on the inverted cone formed by the rollers and subject to an upward component of thrust by a conical star wheel.

DRIVE MECHANISM FOR FULL-SPEED RAM

Figure 13:
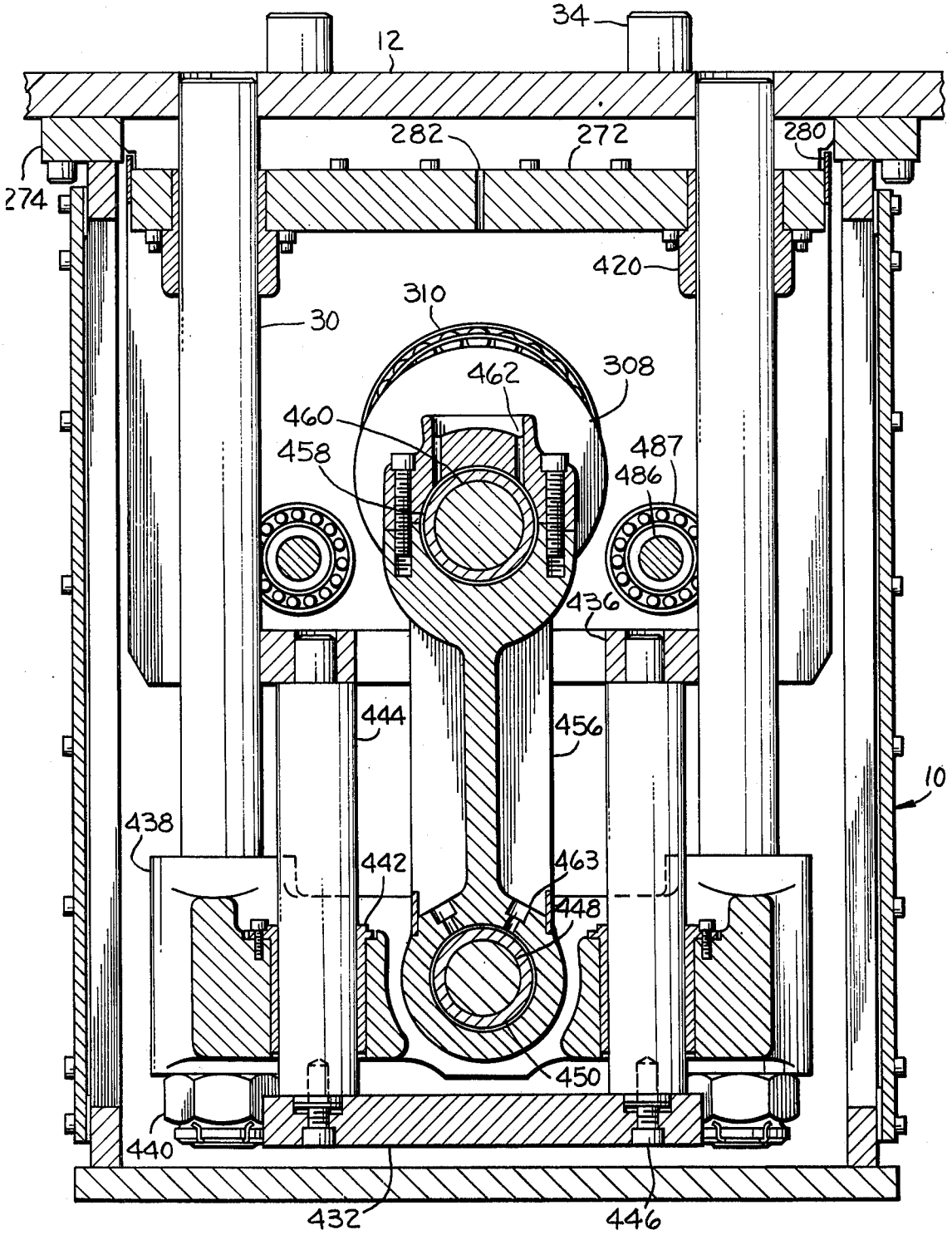
FIG. 13 is a fragmentary sectional view taken along line 13—13 in FIG. 6 looking in the direction of the arrows, showing a first, full-speed drive rod mechanism in end elevation.

The mechanism for reciprocating the first or full-speed ram 24 through the drive rods 30 and their extensions 28 is best shown in FIGS. 6 and 13. The crank portion 460 in the shaft 308 has a plain bearing 458 and is rotatably engaged by a pitman or connecting rod 456, which also rotatably engages a wrist pin 448 having a plain bearing 450 and secured by a set screw 454 in a lower crosshead 438. Openings 452 in the plates 430 and 434 permit ready replacement of the wrist pin and bearing. The bearings 458 and 450 are drip-lubricated through a passage 282 in the lubricant tray defined within the rim 280 surrounding the plate 272, by a cup and passages 462 atop the crank end of the pitman, and by pockets and passages 463 atop the wrist-pin end of the pitman.

The crosshead 438 is vertically reciprocated by the crank 460, being guided in this motion by a pair of slide bushings 442 received on a pair of vertical guide rods 444. The guide rods are supported by horizontal frame members 436 and 432, the latter having screws 446 threaded into the guide rods. The four drive rods 30 are received through slide bushings 420 mounted in the plate 272, and their lower ends are secured to the crosshead 438 by suitable means including nuts 440. The drive rods 30 and the ram 24 are thus driven through one cycle of vertical reciprocation upon each revolution of the crank shaft 308.

DRIVE MECHANISM FOR HALF-SPEED RAM

Figure 15:
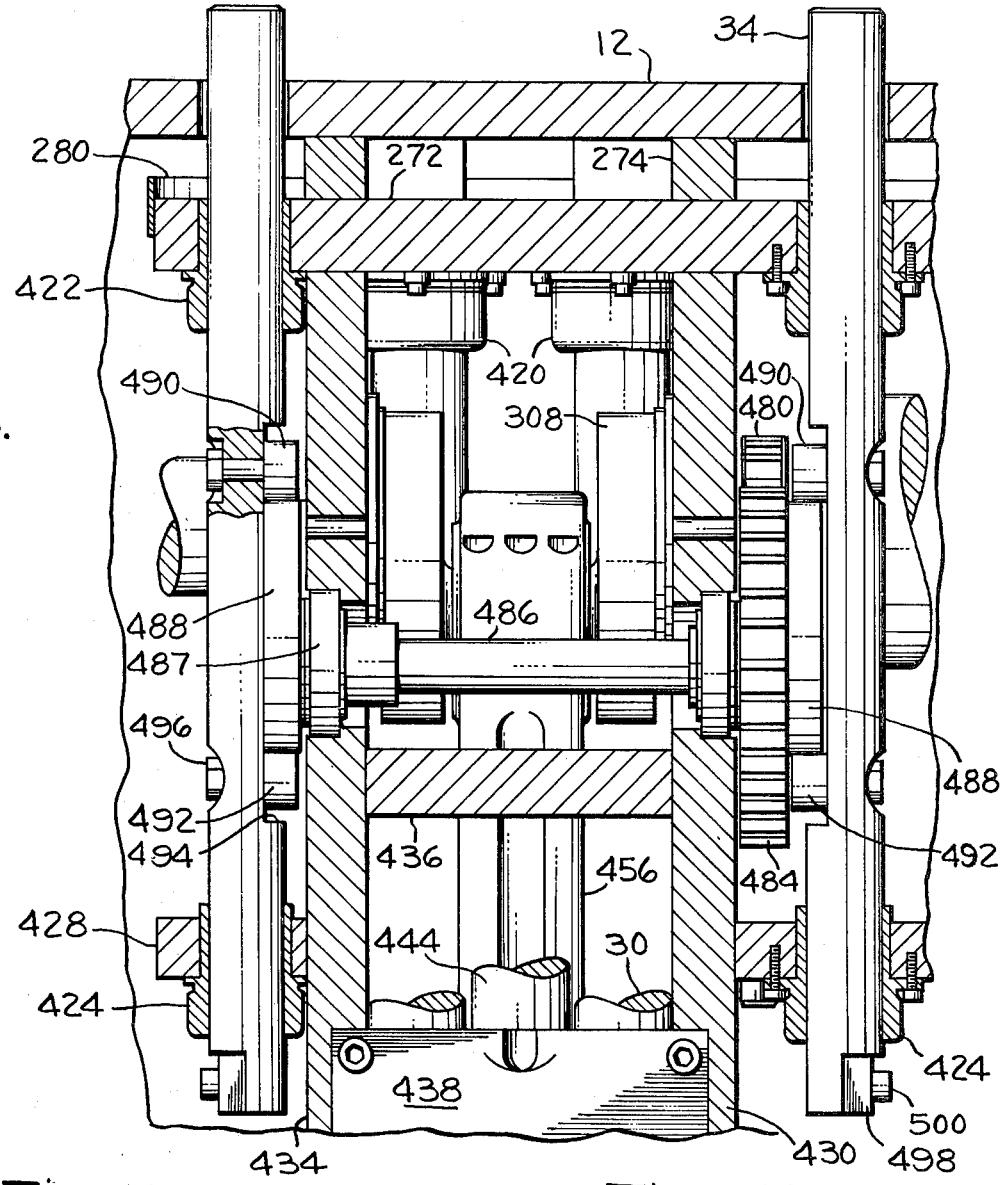
FIG. 15 is a fragmentary sectional view taken along line 15—15 in FIG. 14 looking in the direction of the arrows, showing the full and half-speed drive rod mechanism in side elevation.
Figure 11:
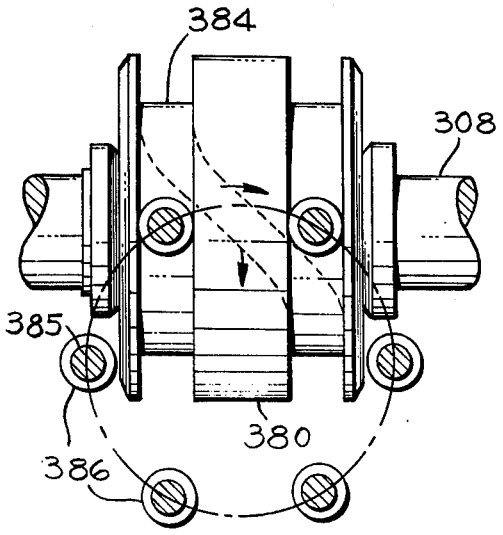
FIG. 11 is a fragmentary sectional plan view taken along line 11—11 in FIG. 6 looking in the direction of the arrows, showing a portion of a dial indexing mechanism.
Figure 12:
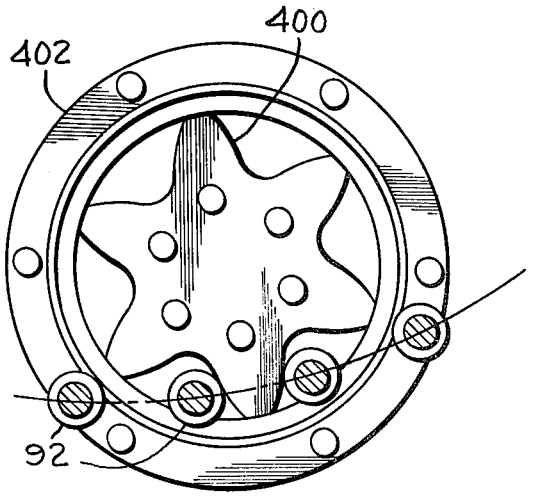
FIG. 12 is a fragmentary sectional plan view taken along line 12—12 in FIG. 6 looking in the direction of the arrows, showing another portion of the dial indexing mechanism.
Figure 14:
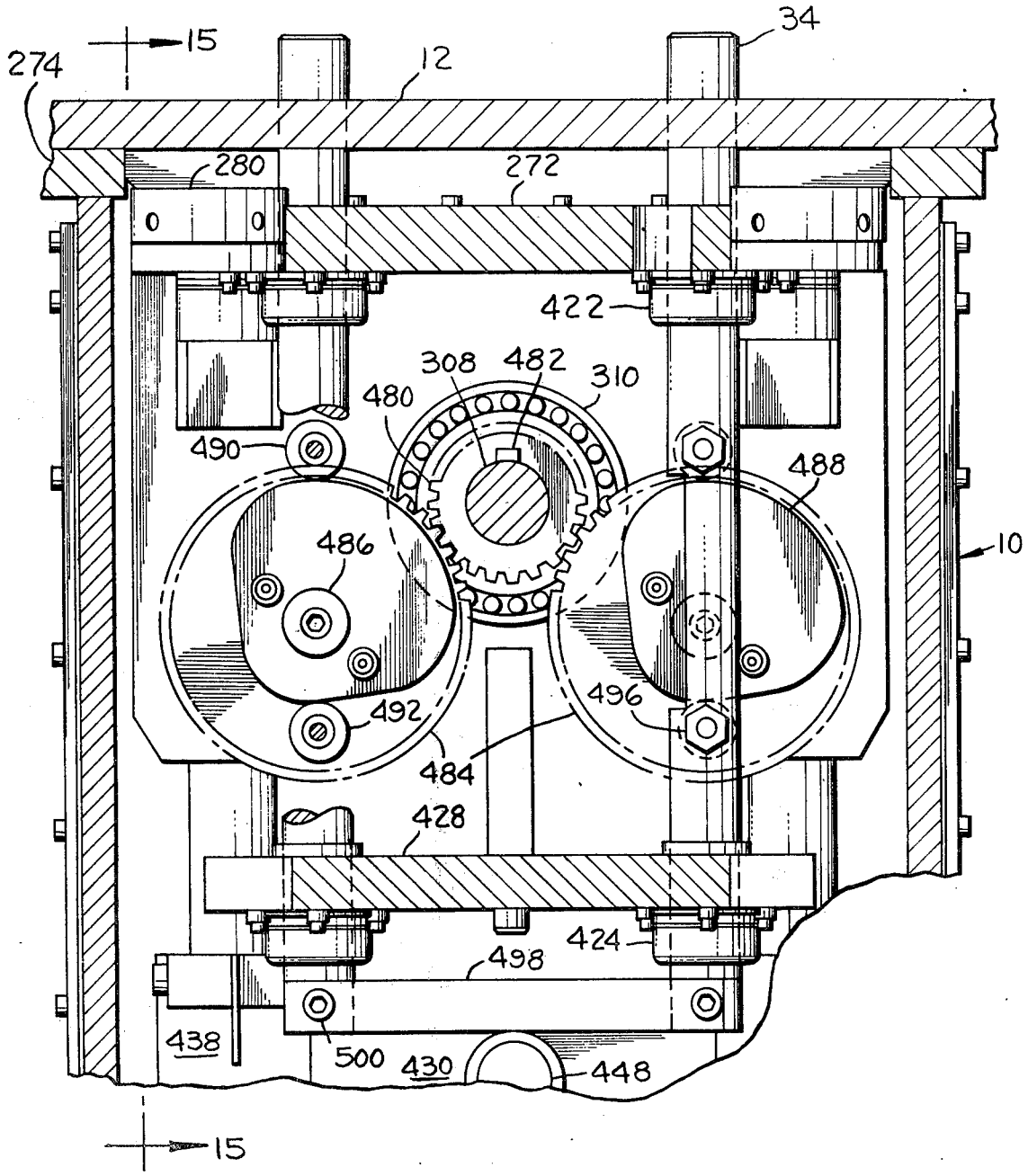
FIG. 14 is a fragmentary sectional view taken along line 14—14 in FIG. 6 looking in the direction of the arrows, showing a second, half-speed drive rod mechanism in end elevation.

The mechanism for reciprocating the second or half-speed ram 26 through the drive rods 34 and their extensions 32 is best shown in FIGS. 6, 14, and 15. The pinion 480, keyed at 482 to the crank shaft 308, drives a pair of gears 484 which are offset to either side of the crank shaft, each being secured to a separate cam shaft 486 rotatably supported in bearings 487 mounted in the frame members 430 and 434. The gears 484 each have twice the pitch diameter of the pinion 480, yielding a speed reduction of 2:1. Each of the two cam shafts 486 has a pair of identical constant pitch diameter cams 488 secured to its opposite ends, and each of these cams cooperates with a pair of cam follower rollers 490 and 492, which are mounted in a flat 494, formed on a corresponding one of the four drive rods 34, by means of nuts 496 threaded on the roller shafts. The drive rods 34 are guided for vertical reciprocation by slide bushings 422 mounted in the plate 272, and by slide bushings 424 mounted in the frame member 428. Lateral pairs of the drive rods are connected by cross bars 498 secured by screws 500, to stabilize the drive rod structure.

The cams 488 are shaped to reciprocate the rods 34 and the half-speed ram 26 once on each revolution of the cam shafts 486, that is, at half the machine cycle rate determined by the crank shaft 308, or half the rate of reciprocation of the full-speed ram 24.

The cams are so phased relative to the crank shaft 308 that the half-speed ram 26 reaches both the top and bottom of its stroke in phase with the full-speed ram 24 attaining the bottom of its stroke, and during intervals when the dial 22 is stationary in an indexed position. Thus the powder and shot loaders 116 dispense their charges at appropriate stations at the same time that various other loading operations are being performed at other stations by the tools carried by the full-speed ram, such as the wad-inserting punch 168 of FIG. 4.

I claim:

1. An ammunition loading machine comprising:

a die set comprising stationary base means, an annular dial having an enlarged central opening and a plurality of peripherally-spaced pocket means for receiving ammunition casings for loading, said base means and said dial being formed with complementary surfaces of revolution, a plurality of roller means spaced about said dial and comprising bearing means each engaging one of said surfaces of revolution to mount said dial on said base means for rotation about a fixed axis for transportation of said pocket means successively to a series of loading stations circumferentially spaced about said axis, and ram means movably mounted on said base means for reciprocation along said axis, said ram means and said base means being adapted for mounting selected tools for performing loading operations on ammunition casings received in said pocket means;

and a drive chassis supporting said base means and comprising indexing means detachably drivingly engaged with said roller means and constructed and arranged to intermittently rotate said dial about said axis to index said pocket means sequentially to said loading stations, drive rod means extending through said base means and said central opening in said dial, detachable connecting means for drivingly engaging said drive rod means with said ram means, and a drive mechanism constructed and arranged for reciprocating said drive rod means and ram means parallel to said axis to perform said loading operations in synchronism with the indexing of said pocket means to said loading stations;

said die set being detachable as a unit from said drive chassis merely by detaching said connecting means and lifting said base means from said drive chassis along said axis to separate said indexing means from said dial and said die set from said drive chassis.

2. A machine as recited in claim 1, including a plurality of said drive rod means and connecting means extending in laterally spaced-apart relation to one another through said base means and said central opening in said dial.

3. A machine as recited in claim 1, said ram means including rod extension means secured thereto, said connecting means drivingly engaging said rod extension means with said drive rod means and combining therewith to form at least one composite rod member drivingly connecting said ram means with said drive mechanism, said composite rod member being slidably received through said base means and extending through said opening in said dial.

4. A machine as recited in claim 3, said detachable connecting means comprising socket joints formed between said rod extension means and said drive rod means.

5. A machine as recited in claim 3, said detachable connecting means comprising studs extending through said rod extension means into threaded engagement with said drive rod means.

6. A machine as recited in claim 3, including a plurality of said composite rod members extending in laterally spaced-apart relation to one another through said base means and said central opening in said dial.

7. A machine as recited in claim 1, said indexing means including a star wheel adapted to drivingly engage said roller means successively, said star wheel having active tooth surfaces adapted to be engaged or disengaged with said rollers upon displacement of said die set along said fixed axis to or from assembled relation with said drive chassis.

8. An ammunition loading machine comprising:

a die set comprising stationary base means, an annular dial having an enlarged central opening and a plurality of peripherally-spaced pocket means for receiving ammunition casings for loading, said base means and said dial being formed with complementary surfaces of revolution, a plurality of roller means circumferentially spaced about said dial and comprising bearing means each engaging one of said surfaces of revolution to rotatably mount said dial on said base means for transportation of said pocket means successively to a series of loading stations circumferentially spaced about said axis, and ram means movably mounted on said base means for reciprocation along said axis, said ram means and said base means being adapted for mounting selected tools for performing loading operations on ammunition casings received in said pocket means;

and a drive chassis supporting said base means and comprising indexing mans including a star wheel engageable with successive ones of said roller means to intermittently rotate said dial about said axis to index said pocket means sequentially to said loading stations, drive rod means drivingly connected with said ram means, and a drive mechanism constructed and arranged for reciprocating said drive rod means and ram means parallel to said axis to perform said loading operations in synchronism with the indexing of said pocket means to said loading stations.

9. A machine as recited in claim 8, said base means including a plurality of arcuate shoes secured in circumferentially-spaced relation about said base means, said shoes forming said surface of revolution of said base means.

10. A machine as recited in claim 8, at least one group of said roller means being mounted on said dial for rotation about axes extending in directions having components parallel to said fixed axis, and rotatably engaging said surface of revolution of said base means; said star wheel drivingly engaging said one group of roller means.

11. A machine as recited in claim 10, said one group of roller means comprising radial bearings locating said dial concentrically about said axis, a further group of said roller means being mounted for rotation about axes extending in directions having components radial to said fixed axis and comprising thrust bearings locating said dial along said axis.

12. A machine as recited in claim 8, said star wheel having active tooth surfaces adapted to be engaged or disengaged with said rollers upon displacement of said die set along said axis to or from assembled relation with said drive chassis.

* * * * *